US006379035B1

(12) United States Patent
Kubo et al.

(10) Patent No.: US 6,379,035 B1
(45) **Date of Patent: *Apr. 30, 2002**

(54) STATIC MIXING AND STIRRING DEVICE

(75) Inventors: Kenji Kubo; Eizo Sugino; Hisayoshi Mese; Shigenohu Saito; Takeshi Yasukochi; Katsutoshi Shoji, all of Osaka (JP)

(73) Assignee: Fujikin Incorporated, Osaka (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/518,368

(22) Filed: Mar. 3, 2000

(30) Foreign Application Priority Data

Mar. 5, 1999 (JP) ..... 11-059366

(51) Int. Cl.[7] ..... B01F 5/06
(52) U.S. Cl. ..... 366/340
(58) Field of Search ..... 251/315.01, 315.16, 251/304, 305, 309; 366/336, 340, 341; 138/42, 44; 48/189.4

(56) References Cited

U.S. PATENT DOCUMENTS 1,262,317 A * 4/1918 Finney et al.
2,815,523 A * 12/1957 Braunlich
3,545,492 A * 12/1970 Scheid, Jr.
3,582,048 A * 6/1971 Sarem
3,917,221 A * 11/1975 Kobata et al.
4,147,481 A * 4/1979 Deutsch
4,280,909 A * 7/1981 Deutsch
4,466,811 A * 8/1984 Johnson, III
4,479,510 A * 10/1984 Bey
5,070,909 A * 12/1991 Davenport
6,012,492 A * 1/2000 Kozyuk

* cited by examiner

*Primary Examiner*—Charles E. Cooley
*Assistant Examiner*—David Sorkin
(74) *Attorney, Agent, or Firm*—Griffin & Szipl, P.C.

(57) ABSTRACT

A primary object of the present invention is to provide a static-type mixing and stirring device which allows for reduction in size of the device and for substantial reduction in the costs of manufacturing the device, while at the same time lowering pressure loss and enhancing the mixing and stirring performance of the device. To achieve the object of the present invention, the static-type mixing and stirring device comprises a cylindrical case body, a plural number of disk-shaped elements—equipped with plural kinds of holes at prescribed intervals—combined and fitted in sequence into the case body, and joint metals removably fitted to the ends of the inlet and outlet of the body case.

1 Claim, 13 Drawing Sheets

PRIOR ART

PRIOR ART

STATIC MIXING AND STIRRING DEVICE

FIELD OF THE INVENTION

This invention relates to improvements in a mixing and stirring device of the static type. Such devices are intended for use primarily in plants for the manufacture of chemicals, medicines, foods, paints, paper, and the like.

BACKGROUND OF THE INVENTION

Static-type mixing and stirring devices, capable of mixing and stirring fluids without using mechanical power, demonstrate such excellent, practical effects as (1) applicability of any possible combinations of fluids, gases, and solids, (2) limited power requirements to compensate pressure loss in the mixing and stirring device, thus achieving substantial energy savings, (3) a simplified noise reducing, trouble-free structure due to no involvement of movable parts, and (4) the possibility of reducing the size of the mixing and stirring device.

FIG. 27 illustrates one example of a prior art mixing and stirring device of the Kenix type which has been put in practice. This static-type, or static, mixing and stirring device is constituted by a 180° right-twisting spiral-shaped mixing element B, the length of which is approximately 1.5 times that of the inner diameter of the case body A, and a 180° left-twisting spiral-shaped element C, designed so that both elements cross each other at a right angle and are fitted into a cylindrical case body A in sequence. Fluids D fed into the case body A in the direction of an arrow are first divided into two by the first left-twisting spiral-shaped mixing elements C1, and further divided into two by the first right-twisting spiral-shaped mixing element B1, and the fluids are lastly divided into $S=2^n$ (where n is the number of mixing elements), and pushed out of the case body A.

Further, each element B.C is designed so that the right-twisting and the left-twisting are arranged alternately. Therefore, whenever the afore-mentioned divided fluids pass through each element B.C, the flow is inverted at the interface of each element B.C as shown in FIG. 23, and advance continuously while converting the flow direction from the center part to the wall part (FIG. 29 in case of the right-twisting spiral-shaped mixing element B) and wall part to the center part (FIG. 30 in case of the left-twisting spiral-shaped mixing element C) along the twisted surface of each element B.C. With each element B.C, the flow of fluids D is continuously served by the afore-mentioned actions of division, inversion, and conversion to allow fluids D to be mixed and stirred effectively, thus resulting in lower pressure loss.

As shown in the afore-mentioned FIG. 27, the conventional mixing and stirring device of the static type has excellent and practical effects, as discussed above. However, there remain many problems to be solved with the conventional mixing and stirring devices, such as the device illustrated in FIG. 27. These problems include: (1) how to make it possible to substantially reduce production costs by further simplifying the structure, and (2) how to make it possible to further enhance mixing and stirring capabilities with a structurally simplified and smaller sized device.

The mixing and stirring device in FIG. 27 employs very complicatedly formed 180° right-twisting spiral-shaped mixing and stirring element B and 180° left-twisting spiral-shaped mixing and stirring element C. Therefore, the manufacture of each element B.C is not an easy task, which makes it difficult to realize the substantial cost reduction in manufacturing the mixing and stirring device.

In addition, there remain some other problems. In order to reduce pressure loss with the mixing and stirring device for smoother mixing, it becomes necessary that the length of each element B.C needs to be approximately 1.5 times longer than the inner diameter of the case body A. Also, in order to improve mixing and stirring performance, it becomes necessary that a large number of elements B.C be employed. Thus it is inevitable that the static-type mixing and stirring device is large in size.

Further, with each element B.C employed in the device in FIG. 27, the division number of fluids is limited to 2, and the division number S of fluids becomes $S=2^n$ (where n is the number of mixing elements). For example, even when 10 pieces of the element B.C are employed, the division number remains only approximately $1\cdot10^3$. As seen in the result, another disadvantage of the device is that, in order to enhance mixing and stirring abilities by increasing the division number S, it becomes inevitable that more numbers of elements B.C are required, thus being unable to avoid the need to make the size of the device larger. Furthermore, because of these disadvantages, the velocity gap between fluids or shearing force will be lowered, and sufficient mixing performance cannot be expected.

The afore-mentioned disadvantages are in regards to the mixing and stirring device of the static type illustrated in FIG. 27. However, there is no need to say that these disadvantages can also be applied to other conventional mixing and stirring devices of the static type. Sufficient mixing effects cannot be expected with static-type mixing and stirring devices of a simple structure as disclosed by the prior art, and to gain sufficient mixing effects, it becomes structurally complex and costly, and the entire device becomes large in size, and the disadvantages remain unsolved.

SUMMARY OF THE INVENTION

An object of the present invention is to provide solutions to problems with the conventional static-type mixing and stirring devices. Problems addressed by this invention are those mentioned above, such as (1) the structural complexity of elements which form a mixing an stirring device, thus making its manufacture troublesome and the reduction of manufacturing costs difficult, (2) a need to increase the number of elements in use to enhance the mixing and stirring performance, resulting in a large-sized device and increase in pressure loss, and (3) a need to increase the division number for the reason that the division number of fluids per element is small, thus requiring more elements to be used to enhance the mixing and stirring performance, also making the device larger in size and production costs higher.

Another object of the present invention is to provide a mixing and stirring device that permits a simple structure and that reduces production costs considerably, and also enables a large division number S of fluids with a small number of elements in use by increasing the fluid division number S per element, and further enables the entire device to be smaller in size and brings about synergistic effects of shearing force (a velocity gap between fluids) and cavitation (an abrupt pressure gap between fluids), which are necessary to enhance mixing and stirring performance, thus allowing the size of the whole device to be small and providing considerable improvements in its mixing and stirring performance.

The present invention according to a first embodiment comprises fundamentally: a cylindrical case body, multiple kinds of disc-shaped elements which are combined and fitted in sequence into the case body and are provided with multiple holes at prescribed intervals, and joint metals removably fitted at the ends of the outlet and inlet of the case body.

The present invention according to a second embodiment comprises fundamentally the first flange forming a storage cavity at the inner part of the central hole part, the second flange fitted to the afore-mentioned first flange facing each other and forming a storage cavity at the inner part of the central hole part, multiple kinds of disc-shaped elements which are combined and fitted in sequence into the case body and are provided with multiple holes at prescribed intervals, and the fixture to fit and fix both of the afore-mentioned flanges.

The present invention according to a third embodiment comprises fundamentally a valve body equipped with a flow passage arranged so as to move freely inside the valve body, a storage cavity formed inside the flow passage of the afore-mentioned valve, and multiple kinds of disc-shaped elements which are combined and fitted in sequence into the case body and are provided with multiple holes at prescribed intervals, and all of which are stored inside the valve.

In the invention according to the first embodiment modified to form a fourth embodiment, the present invention employs the flanges removably fixed at both ends of the case body in place of the joint metals, and removably integrates both flanges and the case body by means of joint bolts and nuts in the invention.

In the second embodiment of the invention as modified to form a fifth embodiment, the present invention employs the bolts and nuts to clamp the flanges directly or the half-split shaped clamping metals and the bolts and nuts to clamp and fix both clamping metals in place of the fixture.

In the third embodiment of the invention as modified to form a sixth embodiment, the present invention employs a ball-shaped valve body of the ball valve, a flat-plate-shaped valve body of the butterfly valve, or a flat-plate-shaped valve body of the gate valve in place of a valve body.

The first, second, and third embodiments of the invention are modified to form a seventh embodiment, wherein the seventh embodiment employs two types of elements, the element 1 and the element 2, and with the former the squarely positioned plural number of polygonal pyramid frustum shaped hole parts of conical frustum shaped hole parts are arranged so that the center Q of the said polygonal pyramid frustum shaped hole part or conical frustum shaped hole part is positioned differently from the center O of the disc body, and with the latter the squarely positioned plural number of polygonal pyramid frustum shaped hole parts of conical frustum shaped hole parts are arranged so that the center Q of the said polygonal pyramid frustum shaped or conical frustum shaped hole and the center of the disc body are overlapped and positioned, thus both the first element and the second element are placed alternately one on another with the large opening side of the polygonal pyramid frustum shaped hole part or the conical frustum shaped hole part placed at the upstream side of fluids .

In the seventh embodiment of the invention as modified to form an eighth embodiment, the present invention of the eighth embodiment is designed to have a plurality of the polygonal pyramid frustum shaped hole parts or conical frustum shaped hole parts in both the first and second elements, wherein the sizes of the holes of both the first and second elements are the same and a means to regulate the fitting positions of the first and second elements is provided.

The ninth embodiment of the present invention is a modification of both the seventh and eighth embodiments, wherein the ninth embodiment is designed so that the hold part is regular quadrangular pyramid frustum shaped.

The tenth embodiment is a modification of the first, second and third embodiments, wherein, the present invention employs two types of elements, the first element and the second element, and with the former the squarely positioned plural number of hole parts equipped with the reduced diameter part halfway are arranged so that the center Q of the hole part is positioned differently from the center O of the disc body, and with the latter the squarely positioned plural number of hole parts equipped with the reduced diameter part halfway are arranged so that the center Q of the said hole part and the center O of the disc body are overlapped.

The eleventh embodiment, being a modification of the tenth embodiment, is designed such that the first element is provided with a plurality of the hole parts equipped with the reduced diameter part halfway of the first element, the second element is provided with a plurality of the hole parts equipped with the reduced diameter part halfway of the second element, the sizes of holes of both the first and second elements are the same, and a means to regulate the fitting positions of the first and second elements is provided.

The twelfth embodiment, being a modification of the tenth and the eleventh embodiment, is designed so that the holes equipped with the reduced diameter part halfway of the element are sandglass shaped.

DESCRIPTION OF PREFERRED EMBODIMENTS

Following are descriptions of embodiments of the present invention, with reference to the drawings.

Figure 1:
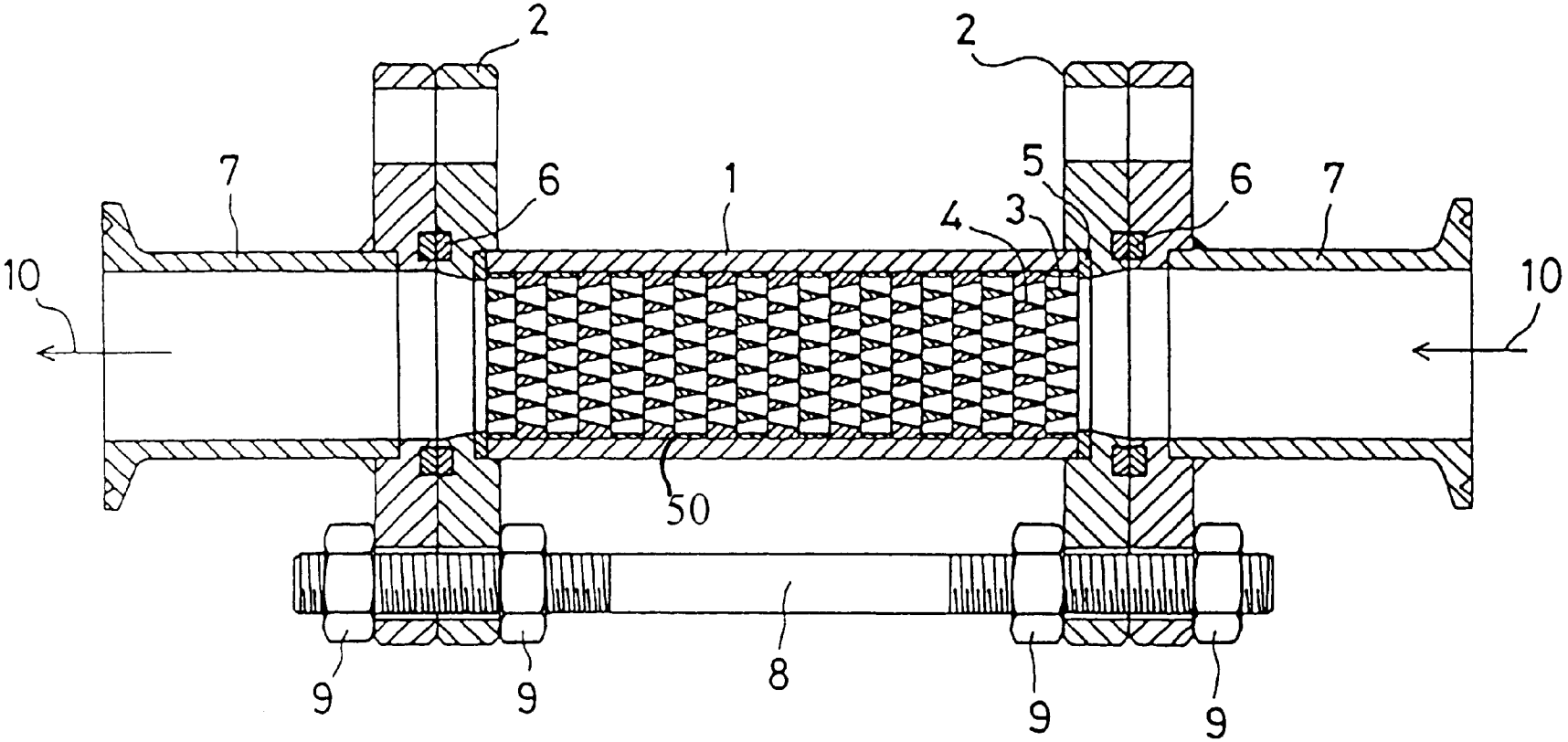
FIG. 1 is a longitudinal sectional view of a mixing and stirring device of the static type according to the first embodiment of the present invention.

Referring to FIG. 1, there is shown a longitudinal sectional view of the mixing and stirring device of the static type according to the first embodiment of the present invention, wherein: 1 is a cylindrical case body; 2, a flange; 3, the first element; 4, the second element; 5, a gasket; 6, an O-ring; 7, a short tube; 8, a connecting bolt; and 9, a nut.

The afore-mentioned case body 1 is made of stainless steel and formed in a cylindrical shape, and is airtightedly and removably fitted and fixed to the flanges 2 via gaskets 5. The short tubes 7.7 (ferrule flanges) are attached to the afore-mentioned flanges 2.2 on the upper and lower stream sides via an O-ring 6.6, and the nut 9 connected to the connecting bolt 8 is tightened so that the case body 1 and both flanges 2.2 and the short tubes 7.7 are removably integrated.

Referring to this embodiment, the stainless steel made case body 1 as explained above, and the stainless steel (SUS304) made flange 2, short tubes 7.7 (ferrule flange) and nuts 9.9 are used. However, there is no need to say that other materials, such as ceramics, any type of alloys, or synthetic resins, can be chosen depending upon the type of fluids for the case body 1, the flange 2, and other factors. Referring further to this embodiment, NBR and NBR80° are in use for an O-ring 6 and a gasket 5, respectively. However, other materials can be appropriately chosen for the O-ring and the gasket, depending on the type of fluids.

Referring to the embodiment shown in FIG. 1, a case body 1 wherein the prescribed number of the first element 3 and the second element 4 are alternately fitted is integratedly fitted to flanges 2.2 and short tubes 7.7 by means of multiple connecting bolts 8.8 and nuts 9.9. However, any other fitting mechanisms can be employed if the mechanism allows the case body 1 to be airtightedly and removably integrated with flanges 2.2 and short tubes 7.7.

Referring to the embodiment shown in FIG. 1, flanges 2.2 are in use as the joint metals to connect with the short tubes 7.7. However, it is also possible that a screw-type socket is used to replace flanges 2.2.

Referring further to the embodiment shown in FIG. 1, the case body 1 is designed to be cylindrical with a round-cross section. However, needless to say, the cross-section of the case body 1 is not limited to a round shape, but its shape can be elliptical or polygonal.

Referring to FIG. 1, fluid 10 is pressed into the case body 1 as an arrow indicates from the upper stream side and undergoes mixing and stirring when passing through the multiple hole parts of the first element 3 and the second element 4 fitted to the case body 1 as described below, and after mixing and stirring is performed fluid 10 is pushed out of the lower stream side of the case body 1 as an arrow indicates.

The afore-mentioned fluids 10 can be of any combination of homogeneity or heterogeneity, such as liquid-liquid, gas-liquid, solid-liquid, solid-gas, liquid-gas-solid. The mixing and stirring device of the static type according to the present invention is capable of mixing and stirring any substances with flowability, regardless of whether they are high viscosity substances or powdered substances.

Figure 2:
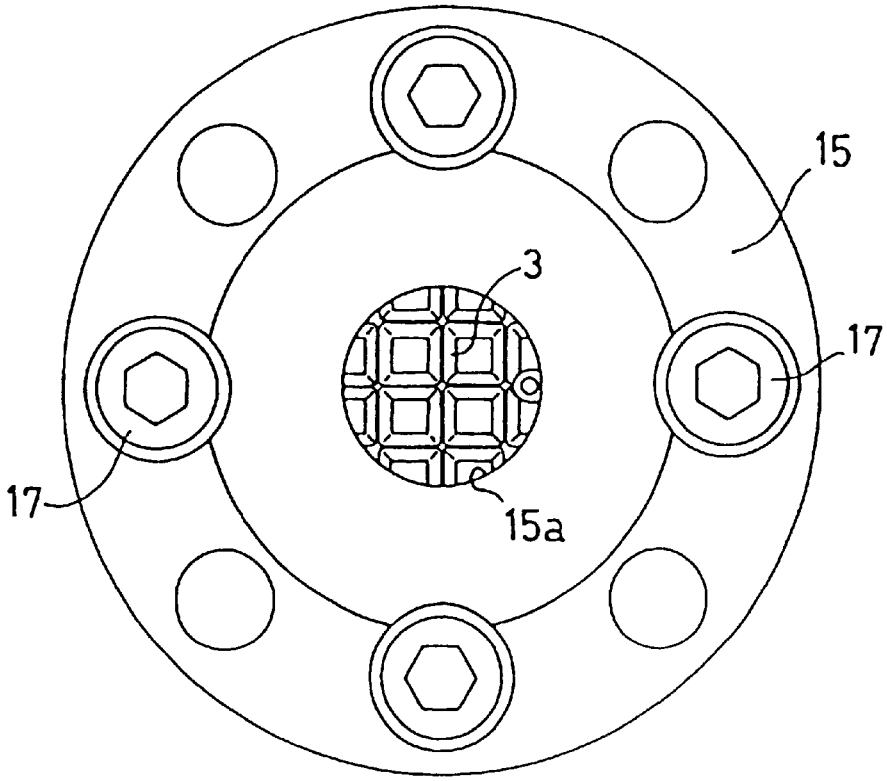
FIG. 2 is a front view of a mixing and stirring device of the static type according to the second embodiment of the present invention.
Figure 3:
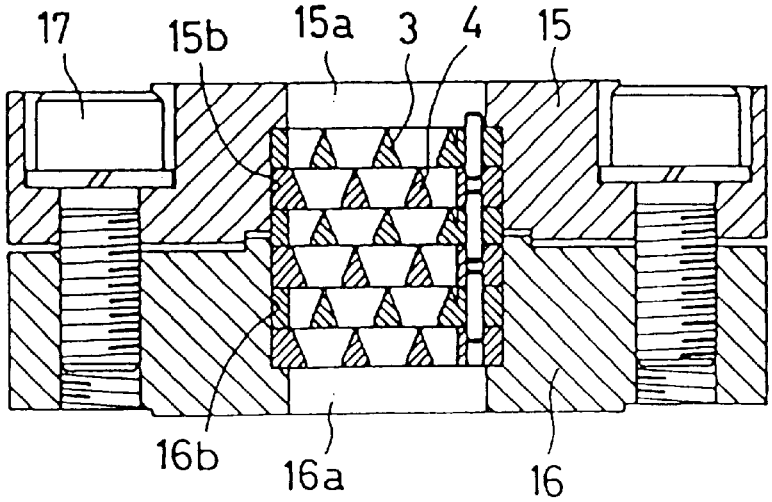
FIG. 3 is a longitudinal sectional view of a mix and stirring device of the static type according to the second embodiment of the present invention.

FIG. 2 and FIG. 3 are a front view and a longitudinal sectional view of a mixing and stirring device of the static type, respectively, according to the second embodiment of the present invention. The static-type mixing and stirring device comprises the first flange 15, the second flange 16, a disk-shaped element constituting the first element 3 and the second element 4, and a fixture 17 consisting of bolts and nuts to airtightedly clamp and fix the flanges 15·16. The center hole parts 15*a*, 16*a* have storage cavities 15*b*·16*b* in a depth thereof which are enlarged in diameter for storing the disk-shaped elements with a circular section. A prescribed number of the first element 3 and the second element 4 are fitted into the storage in a predetermined order, so that the first element abuts against the adjacent second element as shown in FIG. 1. The abutment surface 50 where element 3 abuts against element 4 provides a mixing interface, at which mixing and stirring of fluid will occur as described below. Then the first element 3 and the second element 4 are fixed at a predetermined position in the inner part of the afore-mentioned storage cavities 15*b*·16*b* by fastening the flanges 15, 16.

Figure 4:
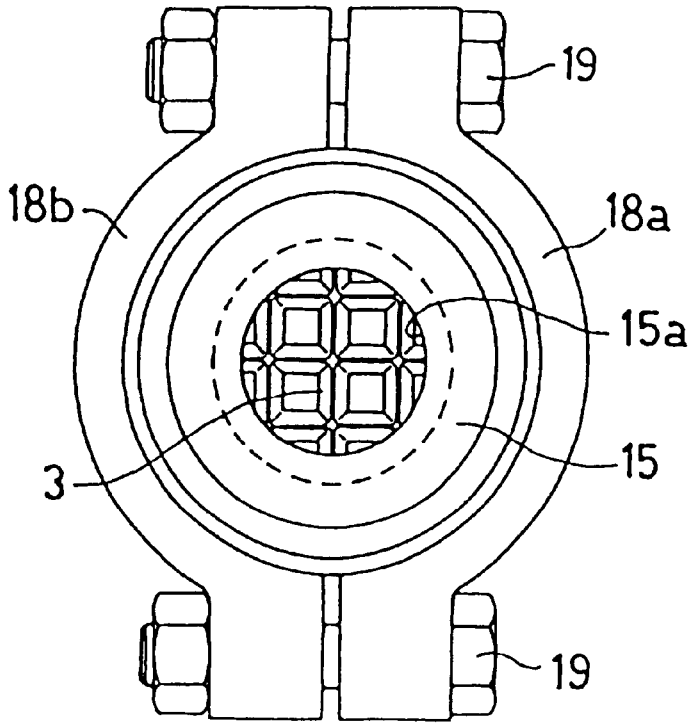
FIG.4 is a front view of a mixing and stirring device of the static type according to the third embodiment of the present invention.
Figure 5:
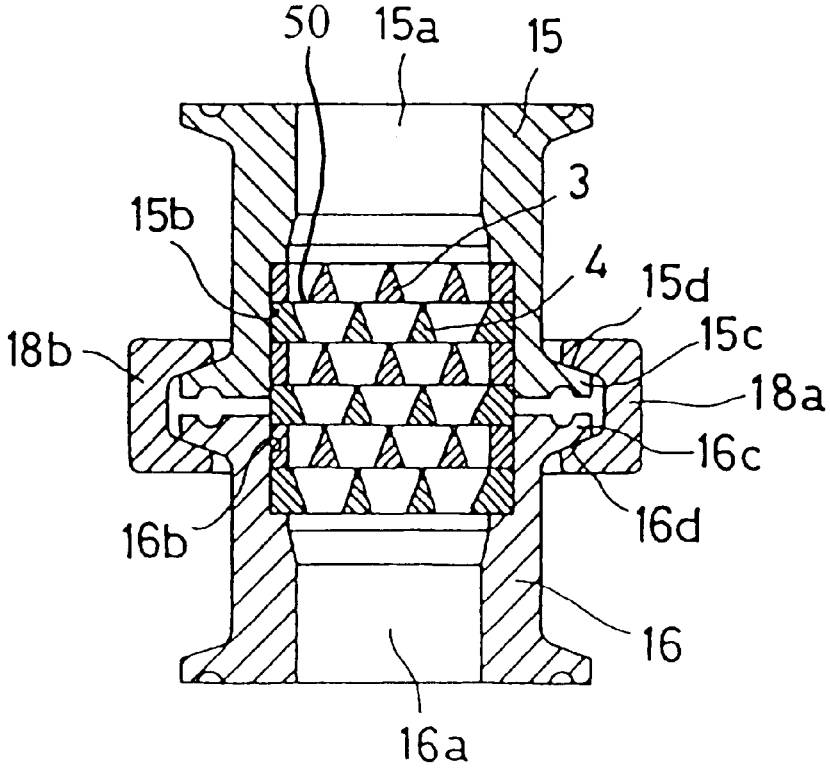
FIG. 5 is a longitudinal sectional view of a mixing and stirring device of the static type according to the third embodiment of the present invention.

FIG. 4 and FIG. 5 are a front view and a longitudinal sectional view of a mixing and stirring device of the static type, respectively, according to the third embodiment of the present invention. Referring to the third embodiment, there are formed the first flange 15 and the second flange 16 slightly longer than in the second embodiment, and outer peripheral faces of the outwardly projected edges 15*c*·16*c* of both the flanges 15, 16 are tapered.

After fitting the first element 3 and the second element 4 into the storage cavities 15*b*·16*b* in the prescribed sequence, the projected edges 15*c*·16*c* of the afore-mentioned flanges 15·16 are placed opposite to each other, and the half-split shaped clamping metals 18*a*·18*b* are fitted to the outer peripheral face of the afore-mentioned projected edges 15*c*·16*c*. The mixing and stirring device of the static type is then formed and assembled by clamping both ends of the clamping metals 18*a*·18*b* with the bolt and nut 19, so that the contact faces of both flanges are fastened airtightedly by means of the afore-mentioned tapered faces 15*d*.16*d*.

Figure 6:
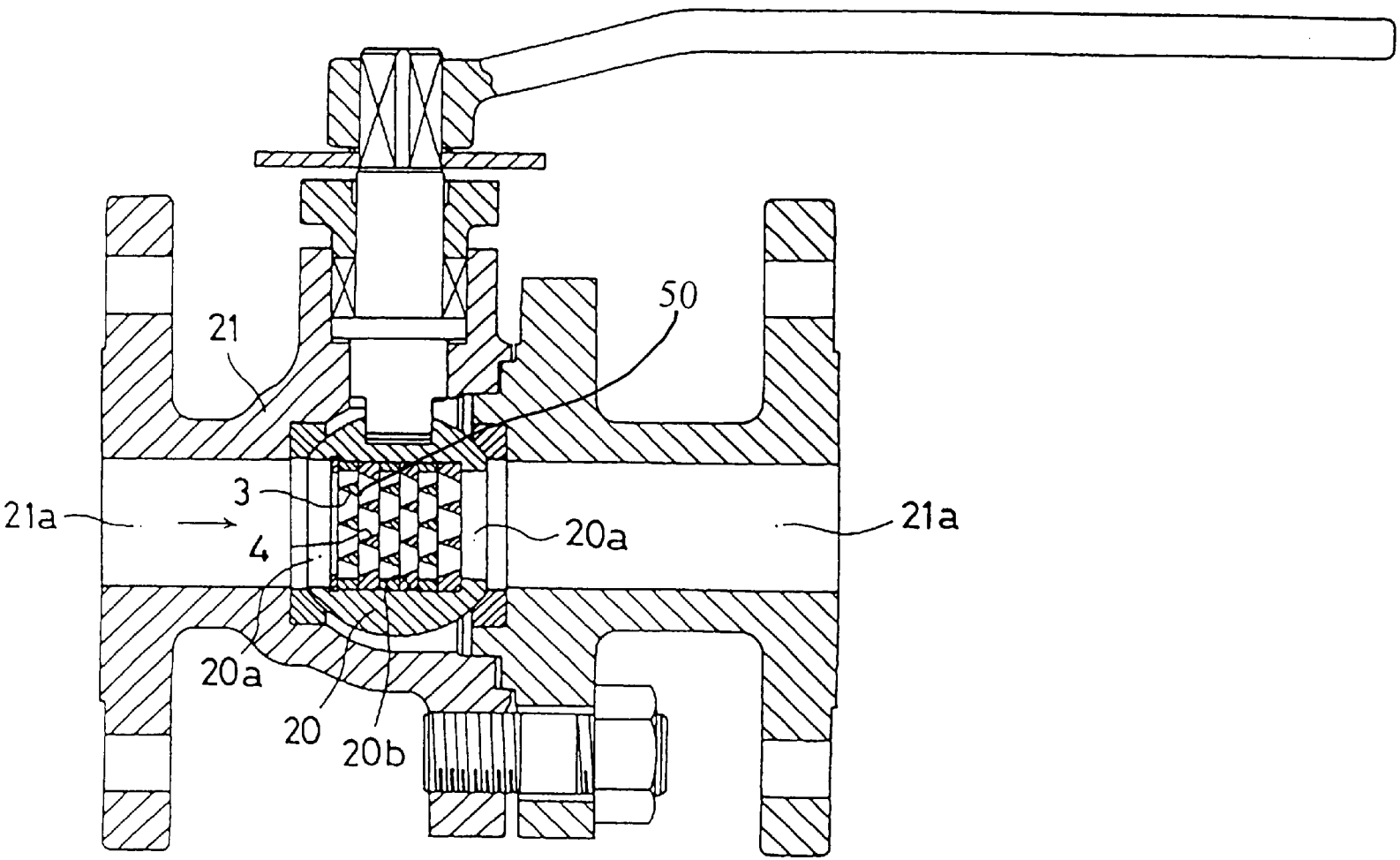
FIG. 6 is a longitudinal sectional view of a mixing and stirring device of the static type according the fourth embodiment of the present invention.

FIG. 6 is a sectional view of a mixing and stirring device of the static type according to the fourth embodiment of the present invention. The disk-shaped elements consisting of the combination of the first element 3 and the second element 4 is fitted into the storage cavity 20*b* provided in the valve body 20. Referring to FIG. 6, 21 is a valve body itself, 21*a* a fluids passage, 20*a* a fluids passage provided in the valve body, and 20*b* a storage cavity. The prescribed number of both elements 3·4 are fitted inside the storage cavity 20*b* in a manner such that their positions are fixed.

Referring to FIG. 6, it is designed so that disk-shaped elements are fitted in a ball-shaped valve body 20 of the ball valve. Concerning the type of the valve 20, needless to say valves such as, for example, a flat-plate-shaped valve body of a butterfly valve or a flat-plate-shaped valve of a gate valve can be employed.

Materials used in the second, third, and fourth embodiments illustrated in the afore-mentioned FIG. 2 to FIG. 6 inclusive are the same as those in the first embodiment in FIG. 1. For this reason, detailed explanations are omitted here.

Figure 7:
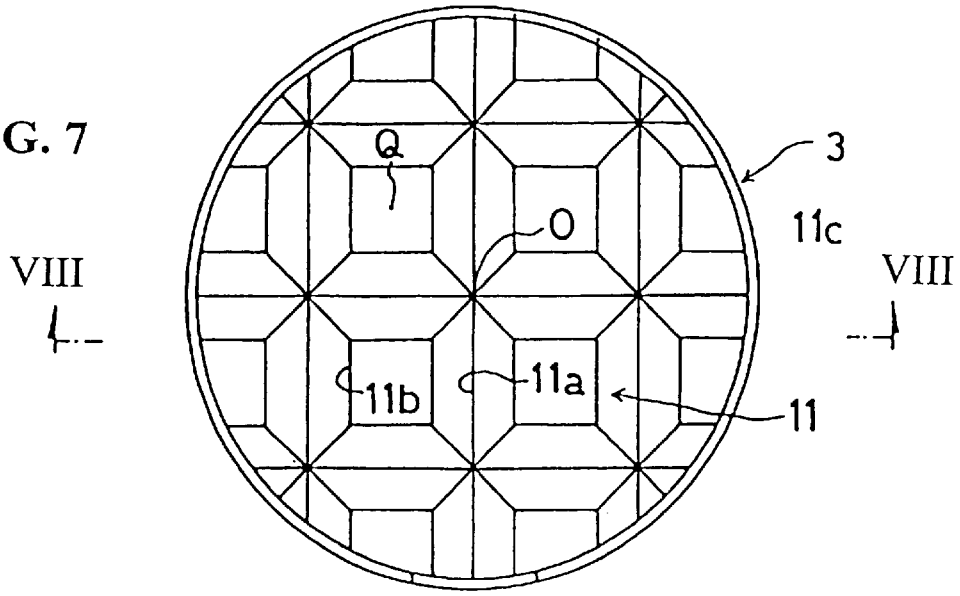
FIG. 7 is a plan view of an element A according to the first embodiment of the invention.
Figure 8:
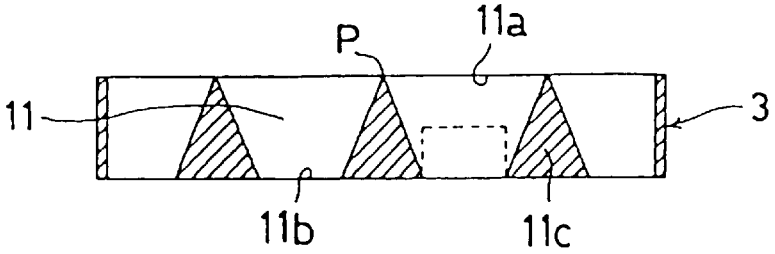
FIG. 8 is a section taken along the line VIII—VIII in FIG. 7.
Figure 9:
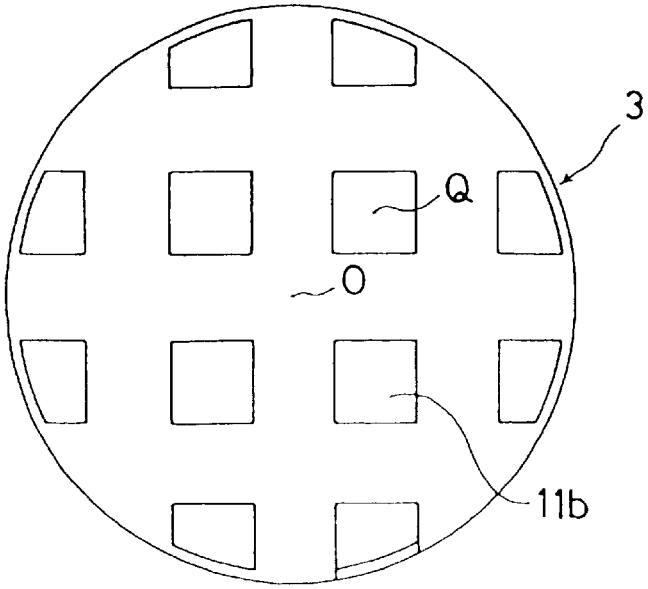
FIG.9 is a rear elevation of an element A according to the first embodiment.

FIG. 7 to FIG. 9 inclusive illustrate a first embodiment of the afore-mentioned first element 3 (a square-shaped element). FIG. 7 is a plan view of the first element 3. FIG. 8 is a section taken along the line VIII—VIII in FIG. 7. FIG. 9 is a rear view of the first element 3.

Referring to FIG. 7 to FIG. 9 inclusive, the first element is formed in a shape of a disk (a round plate) with stainless steel of 5 mm in thickness and an outer diameter of 27.5 mm, and the disk is equipped with multiple (4) square pyramid frustum shaped holes 11 arranged in a square shape.

The upper surface side of the square pyramid frustum shaped hole part 11 forms a large square opening 11*a*, and the lower surface side (the rear side) forms a small square opening 11*b*. The portion surrounded by the adjacent division parts 11*c*·11*c* forms a hole part (perforation), and fluids 10 flow along the inner wall face of the square pyramid frustum shaped hole part 11.

The first element 3 is formed with four pieces of a complete square pyramid frustum shaped hole part 11 and eight pieces of an incomplete hole part 11' respectively, so that the center P of the division body 11*c* which forms the square pyramid frustum shaped hole 11 is positioned at the center O of the disk body. In other words, the position of the center Q of the hole part 11 of the first element 3 is designed so that it does not overlap with the center O of the disk body.

Figure 10:
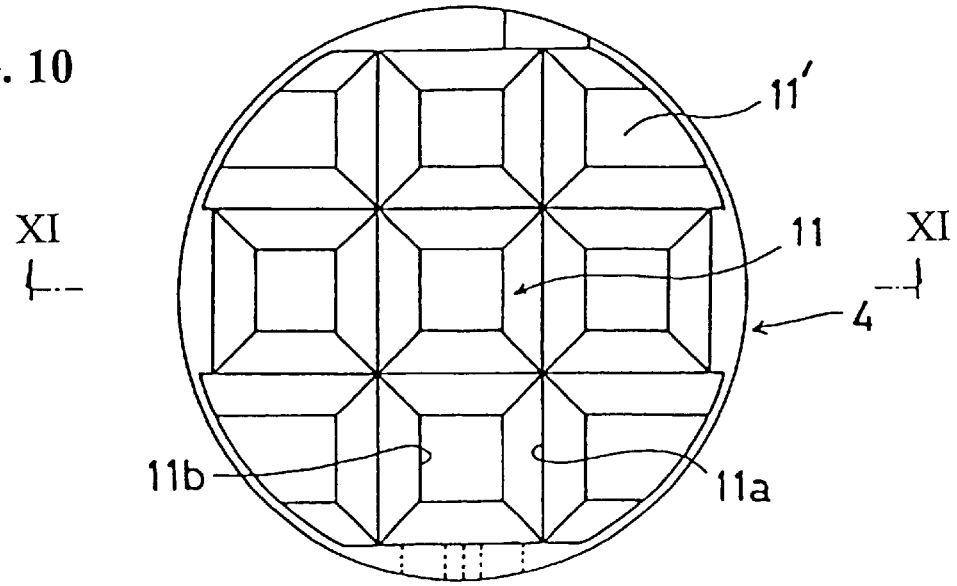
FIG. 10 is a plan view of an element B according to the first embodiment.
Figure 11:
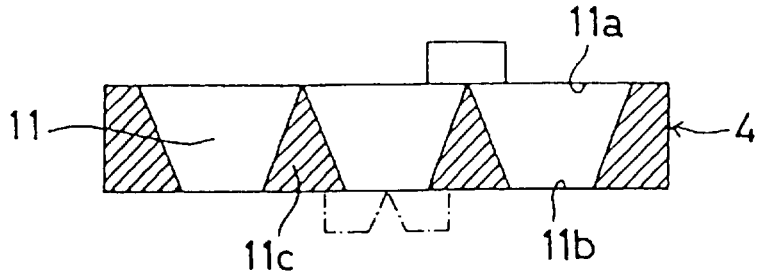
FIG. 11 is a section taken along the line XI—XI in FIG. 10.
Figure 12:
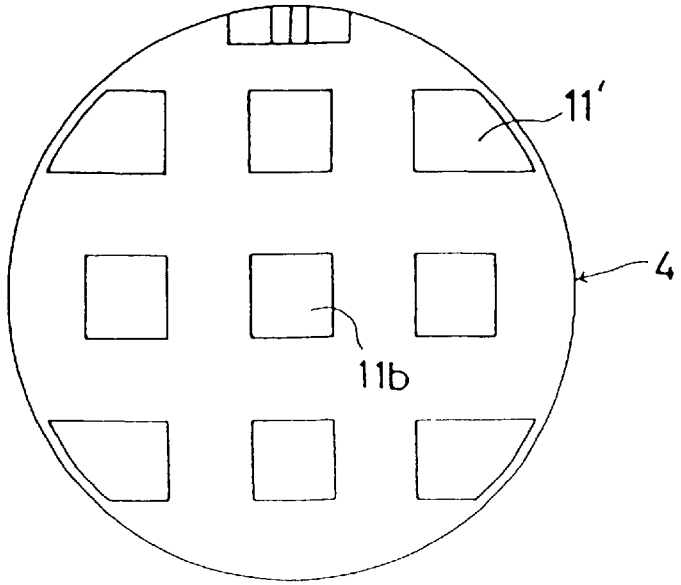
FIG. 12 is a rear elevation of an element B according to the first embodiment.

FIG. 10 to FIG. 12 inclusive illustrate the first embodiment of the afore-mentioned second element 4 (a square shaped element). FIG. 10 is a plan view of the second element 4. FIG. 11 is a section taken along the line I—I XI—XI in FIG. 10. FIG. 12 is a rear view of the second element 4.

Referring to FIG. 10 to FIG. 12 inclusive, said second element is formed in a shape of a disk (a round plate) with stainless steel having a thickness of 5 mm and an outer diameter of 27.5 mm. The disk is equipped with a plural number (5) of a squarely arranged square pyramid frustum shaped hole part 11.

Similarly to the first element 3, the upper surface side of the afore-mentioned square pyramid frustum shaped hole part 11 forms a large square opening 11*a*, and the lower surface side forms a small square opening 11*b*.

Dissimilarly to the afore-mentioned first element 3, the number of incomplete hole parts 11' is four, and the center Q of the opening 11*a* is positioned at the center of the disk body.

The afore-mentioned first element 3 and second element 4 are tightly pressed and fixed by the fitting mechanism, wherein, as illustrated in FIG. 1, element 3 abuts element 4 to provide a mixing interface 50, the opening 11*a* of the upper surface side of the square pyramid frustum shaped hole part 11 is positioned on the inflow side of fluids (the upper stream side). The prescribed number of the first and second elements 3, 4 are alternately fitted into the case body 1 in a build-up shape, employing connecting bolts and nuts.

Figure 13:
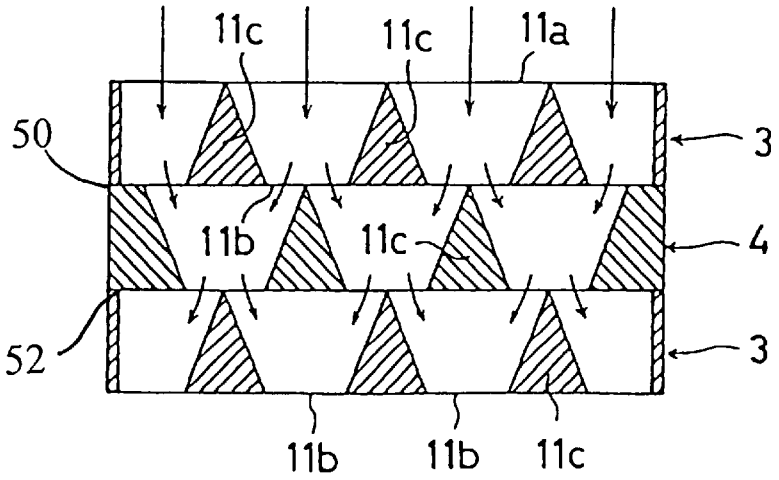
FIG. 13 is a partially longitudinal sectional view showing the fitting state of the first element and the second element according to the first embodiment.

Referring to FIG. 13, a partially longitudinal sectional view is shown, to display the assembling state of the first element 3 and the second element 4 thereby providing a mixing interface 50 according to the first embodiment. As is clear from FIG. 8, fluids 10 flow into the opening 11*a* of the square pyramid frustum shaped hole part 11 from the upper stream side are divided into four while passing through each element 3·4. As shown in FIG. 13 by the flow arrows, fluid flow both diverges as it leaves first element 3 and converges as it enters second element 4 at the mixing interface 50. At mixing interface 52, fluid flow diverges as it leaves second element 4 and converges as it enters first element 3, thereby mixing and stirring the fluid. As a result, for example, when 10 pairs of the elements 3·4 (10 units of first element 3 and 10 units of second element 4) are fitted into a case body 1, the division number of fluids 10 amounts to $S=4^n(n=10) \approx 1.05 \cdot 10^6$, thus making it possible to obtain a very large division number S. Furthermore, the abrupt enlargement and reduction of fluids 10 occurs over 20 times at the interface of each element 3·4.

Referring to FIG. 1 to FIG. 13 inclusive, an explanation regarding the positioning mechanism for fitting the first element 3 and the second element 4 is omitted. However, needless to say, a suitable size of the part to be inlaid for a positioning regulation at the suitable positions of the first element 3 and the second element 4 should be used, so that both elements can be fitted by holding their prescribed relative relation of positioning.

Referring now to FIG. 1 to FIG. 13 inclusive, it is formed that two different elements 3·4, that is, the first element 3 and the second element 4 are alternately fitted. However, there is no need to say that more than two kinds, for example, three kinds, of elements having different arrangements of the regular quadrangular pyramid shaped hole parts 11 can be used for fitting.

Referring to the embodiment shown in FIG. 1, the same thickness (5 mm) and same shape for the hole part 11 are chosen for the first element 3 and the second element 4. However, needless to say, some variations in regards to the elements 3·4 can be applied. For instance, the size of a hole, the area ratio of the top and base of the regular quadrangular pyramid frustum, the arrangement of the hole parts, the diameter and thickness of the disk of an element, and so on, can be modified. Furthermore, the method of arranging the elements, such as the fitting order of elements, can also be altered. That is, the present invention is not limited only to the variations depicted in FIG. 1 to FIG. 12.

Referring next to the operation of the mixing and stirring device of the static type according to the first embodiment of the present invention, with reference to FIG. 1 to FIG. 13 inclusive, fluids 10 to be mixed and stirred are conveyed into the case body 1 through the short tube 7 from the upper stream side in the direction indicated by an arrow while passing through plural pairs of the first element 3 and the second element 4, and fluids 10 are mixed and stirred statically, and pushed out of the lower stream side of the case body in sequence after having been mixed and stirred.

Mixing, stirring, and dispersion of the afore-mentioned fluids 10 take place as a result of the division and aggregation of fluids 10 while passing through a group of the afore-mentioned hole parts 11, the swirls and disorder caused by enlargement and reduction of the cross-sections of the hole parts 11, and also shearing stress occurring while passing through the clearance at the varied velocities of flow. Regarding the elements 3·4, the shapes and sizes of the hole part 11 are appropriately chosen so that mixing and dispersion of fluids 10 occur with greater efficiency.

Though fluids 10 are subjected to considerable shearing stress while repeating division, enlargement, and reduction, the increase of pressure loss is avoided by modifying the shapes of a division body 11*c* and a hole part 11 so that fluids 10 collide with the elements 3·4 at an appropriate angle.

Figure 14:
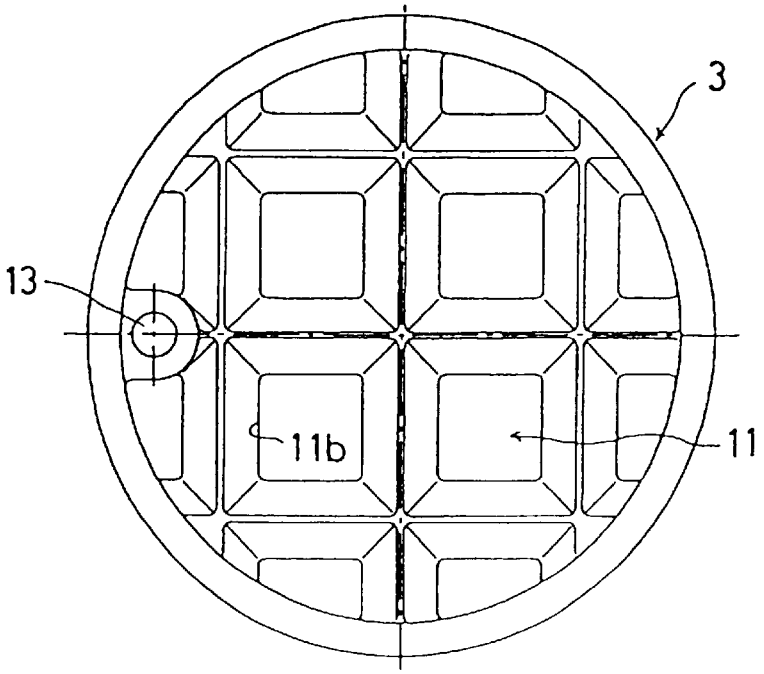
FIG. 14 is a plan view of the first element according to the second embodiment.
Figure 15:
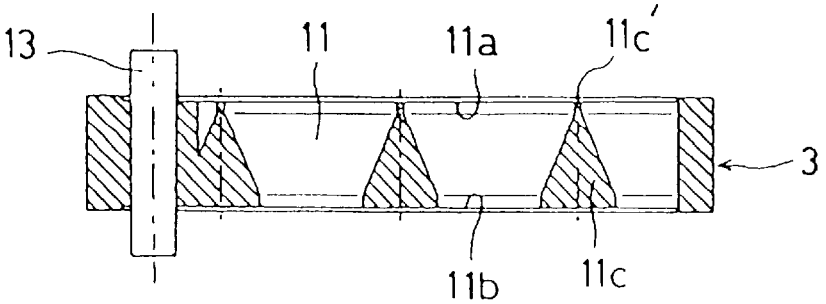
FIG. 15 is a longitudinal sectional view according to the second embodiment.
Figure 16:
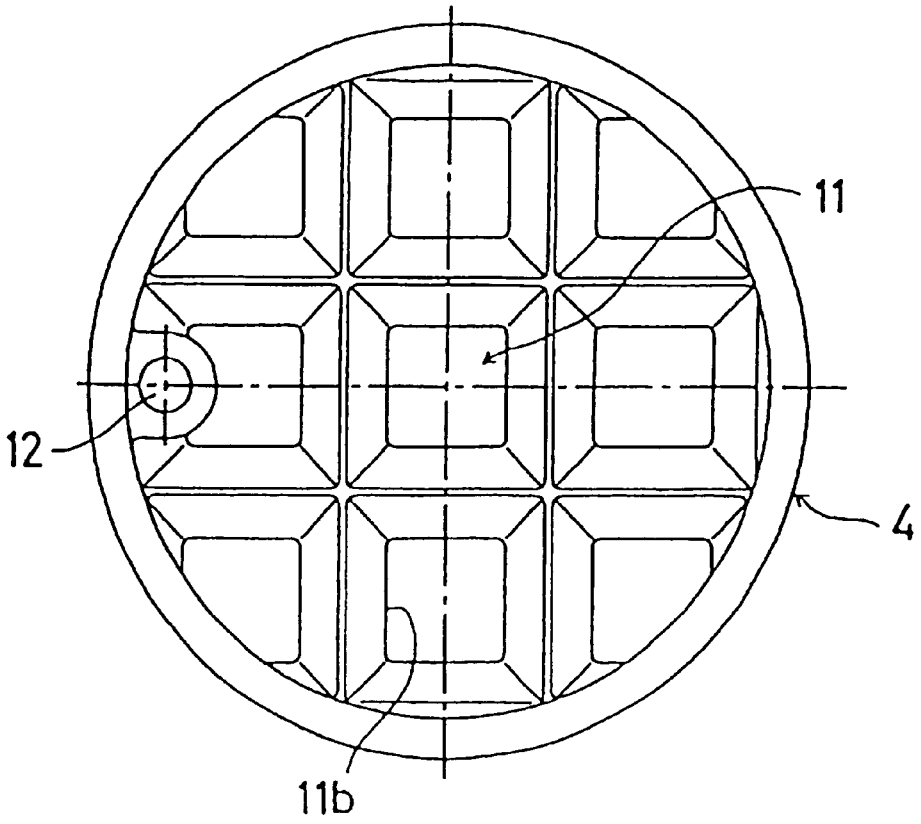
FIG. 16 is a plan view of the second element 4 according to the second embodiment.
Figure 17:
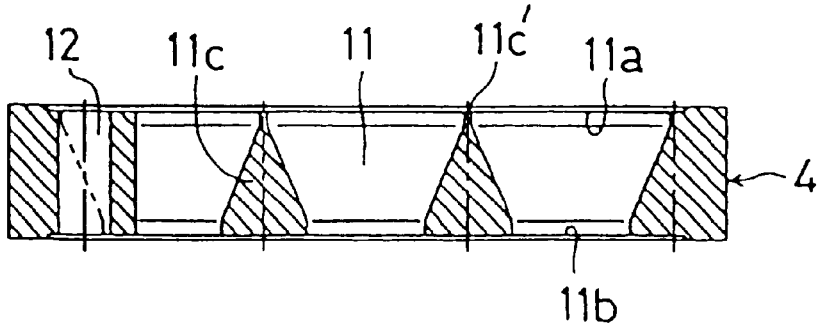
FIG. 17 is a longitudinal sectional view of the second element 4 according to the second embodiment.

FIG. 14 and FIG. 15 are a plan view and a longitudinal sectional view respectively to show the second embodiment of the first element 3. FIG. 16 and FIG. 17 are a plan view and a longitudinal sectional view respectively to show the second embodiment of the second element 4 which is combined with the afore-mentioned first element 3. The first element 3 according to the said second embodiment differs from the afore-mentioned first embodiment (FIG. 7 to FIG. 12) in the points that: a hole 12 and a pin 13 for engagement are provided so that at the time of fitting into the case body 1, both elements 3·4 are accurately combined in a prescribed relative positioning relation; and that the end portion 11*c*' of the division body 11*c* is made in a shape of a plane. All other aspects of the formation remain exactly the same as for the afore-mentioned first embodiment.

Figure 18:
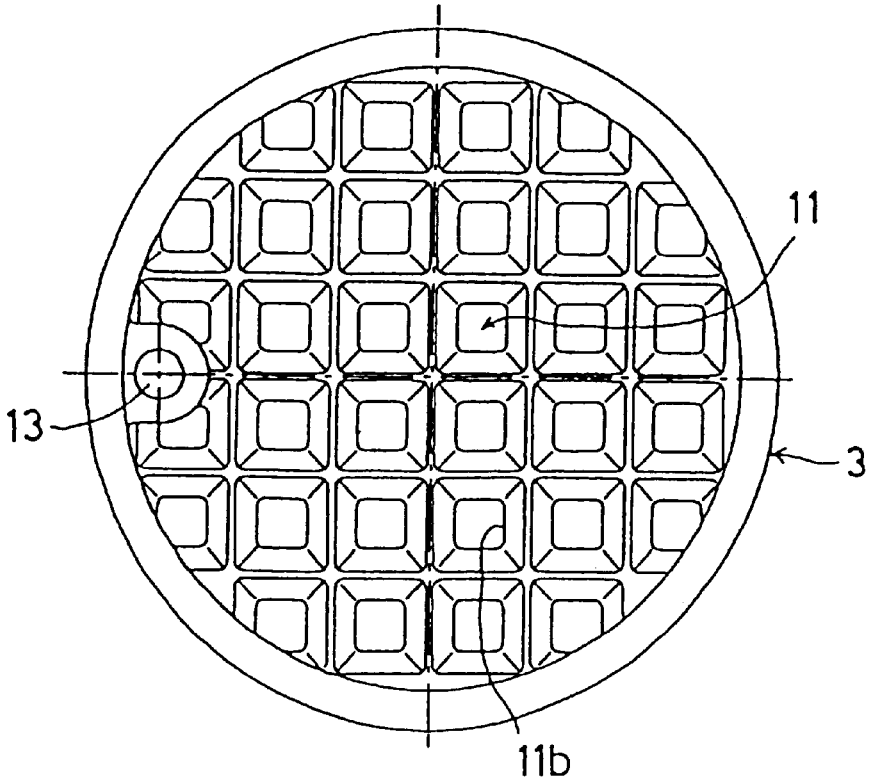
FIG. 18 is a plan view of the first element according to the third embodiment.
Figure 19:
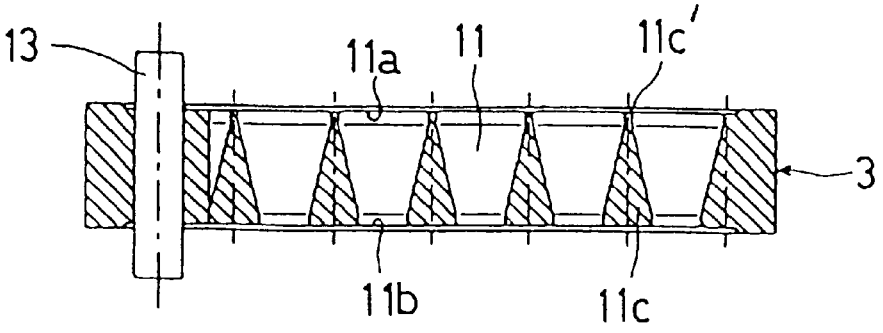
FIG. 19 is a longitudinal sectional view of the first element 3 according to the third embodiment.
Figure 20:
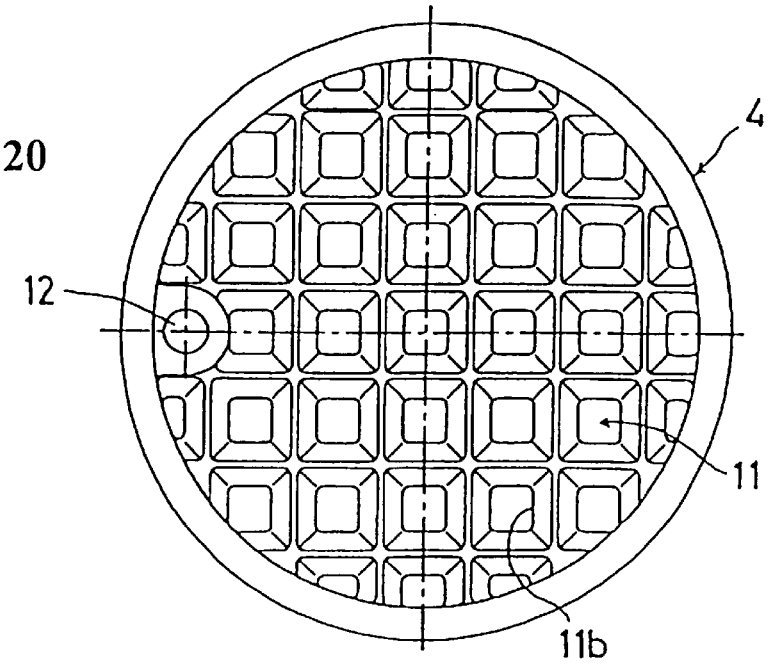
FIG. 20 is a plan view of the second element 4 according to the third embodiment.
Figure 21:
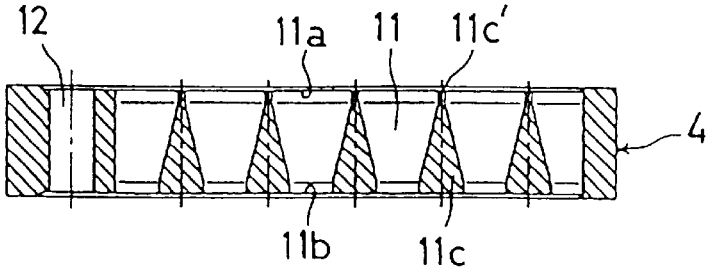
FIG. 21 is a longitudinal sectional view of the second element 4 according to the third embodiment.

FIG. 18 and FIG. 19 are a plan view and a longitudinal sectional view respectively to show the third embodiment of the first element 3. FIG. 20 and FIG. 21 are a plan view and a longitudinal sectional view respectively to show the second embodiment of the second element 4 which is combined with the afore-mentioned first element 3. The only point that differs from the second embodiment (FIG. 14 to FIG. 17) is that there exist a greater number of regular quadrangular pyramid frustum shaped holes 11. All other aspects of formation of the element remain similar to the second embodiment.

With reference to the pyramid shaped element 3·4 in the afore-mentioned first to third embodiments, a regular quadrangular pyramid frustum shape is applied for the hole part 11. However, any polygonal pyramid frustum shapes, such as triangular or pentagonal pyramid frustum shapes, can be applied for the hole part 11.

Figure 22:
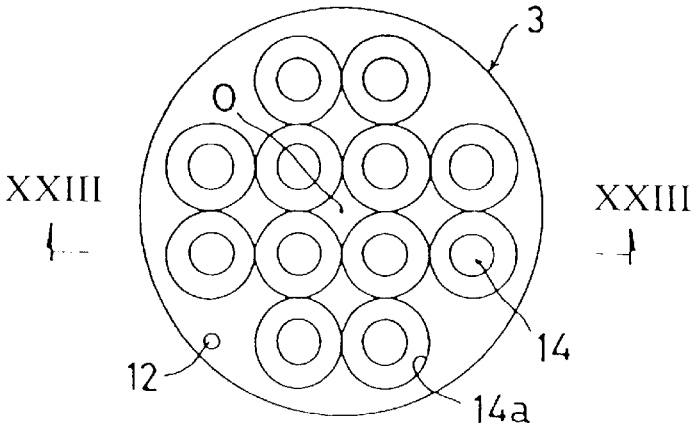
FIG. 22 is a plan view of the first element 3 of the sandglass shaped hole part type according to the fourth embodiment.
Figure 23:
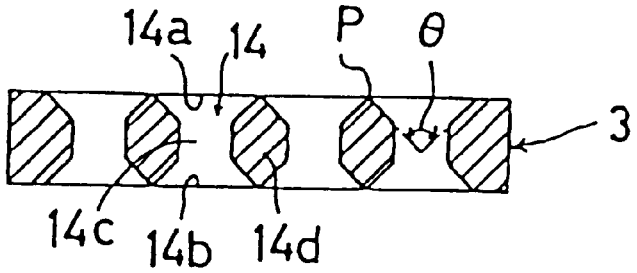
FIG. 23 is a section taken along the line XXIII—XXIII in FIG. 22.

FIG. 22 and FIG. 23 illustrate the fourth embodiment (a round shaped element) of the afore-mentioned first element 3. FIG. 22 is a plan view, and FIG. 23 is a section taken along the line XXIII—XXIII in FIG. 22. The first element 3 according to the fourth embodiment, unlike the first embodiment to the third embodiment, is pitted with a plural number (12 holes) of the hourglass shaped (a shape wherein the small face sides of two conical frustums are connected with a short cylinder) hole parts 14 arranged in a square shape on the stainless steel (SUS316) disk body having a thickness of 5 mm and an outer diameter of 27.5 mm.

As is clear from the embodiment of FIG. 22 and FIG. 23, an opening 14*a* on the upper surface side of the first element 3 and an opening 14*b* on the rear side are formed so that their areas are the same, and an opening 14*c* of the intermediate short cylinder is contracted in diameter so that fluids 10 are subjected to twice as many repetitions of reduction and enlargement as those with the afore-mentioned angular-shaped element (the first embodiment to the third embodiment) while passing through the afore-mentioned sandglass-shaped hole part 14.

In FIG. 22 and FIG. 23, the inner diameters of the openings 14*a*·14*b* are set for 6 mm respectively, while the inner diameter of the opening 14*c* is set for 3 mm. The central pitch of the sandglass-shaped hole part 14 is 6 mm and is arranged in a square shape. Further, the first element 3 is designed so that the center P of the division body 14*d* is positioned at the center O of the disk body (a round plate), and the angle of inclination θ is set at 90°.

Figure 24:
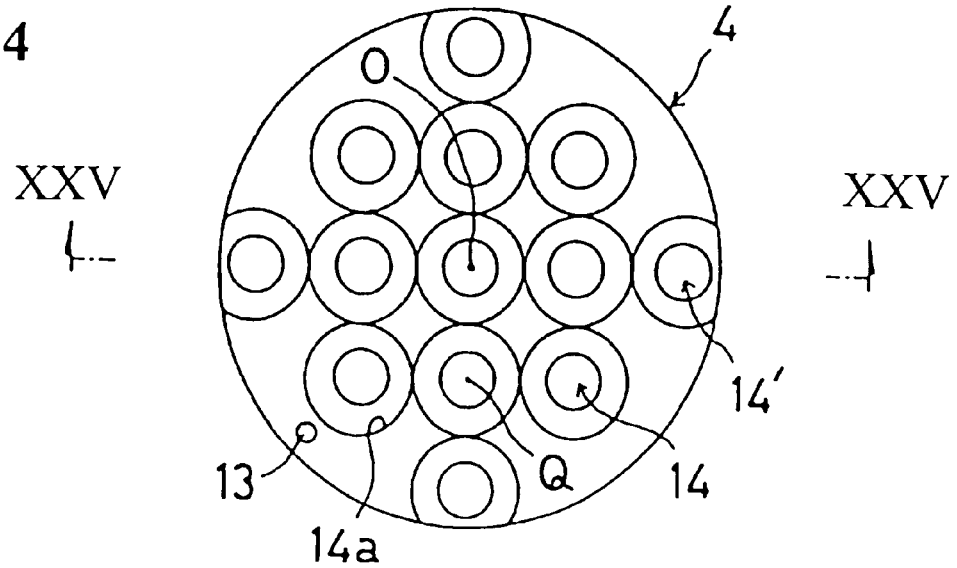
FIG. 24 is a plan view of the second element 4 of the sandglass shaped hole part type according to the fourth embodiment.
Figure 25:
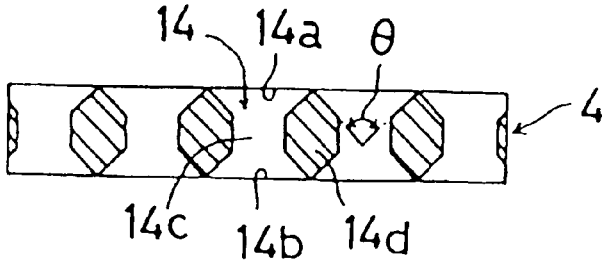
FIG. 25 is a section taken along the line XXV—XXV in FIG. 24.

FIG. 24 and FIG. 25 are a plan view and a longitudinal sectional view of the second element to be used in combination with the afore-mentioned element 3 (FIG. 23 and FIG. 24). In said second element 4, 9 pieces of the sandglass-shaped hole part 11 are pitted, which shape is identical to the afore-mentioned first element. In addition, 4 pieces of the incomplete hole parts 14' are also pitted. In said second element 4, the center position Q of the openings 14*a*·14*b* of the sandglass-shaped hole part 14 is set at the position of the center O of the disk body (a round plate). All other aspects of the formation except this part remain identical to the afore-mentioned first element 3.

In FIG. 24, numeral 13 is a pin to be inserted to a hole 12 of the afore-mentioned first element 3, and the relative positions are regulated at the time of fitting both elements 3·4.

Figure 26:
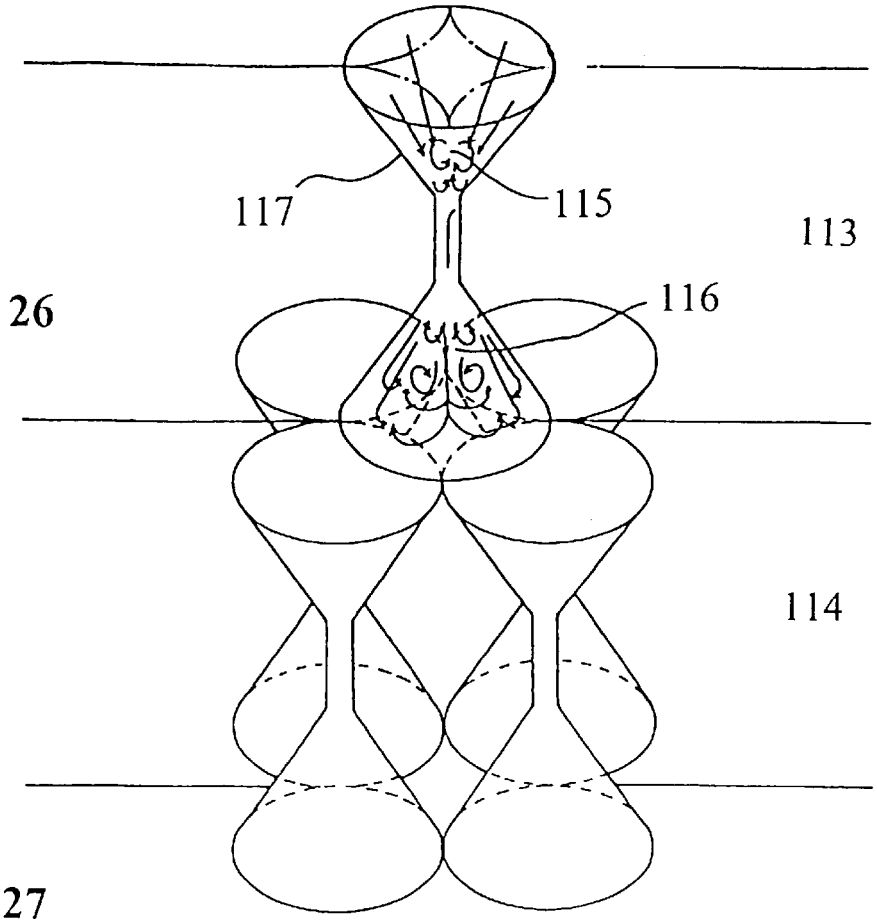
FIG. 26 is a three-dimensional schematic view of the fitting state of the first element and the second element, and the three-dimensional schematic view of a flow of fluids passing through a hole part.
Figure 27:
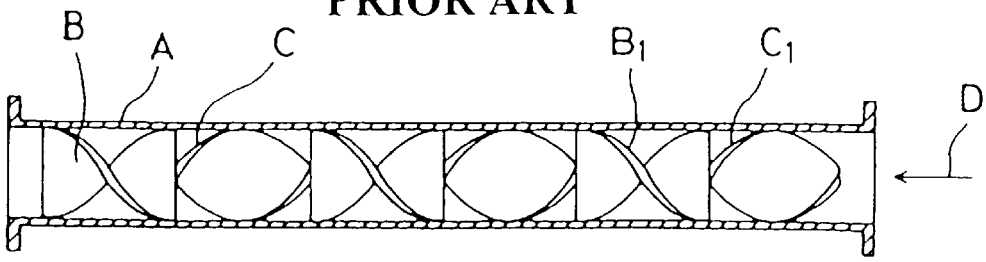
FIG. 27 PRIOR ART
FIG. 27 is a schematic longitudinal sectional view of a conventional mixing and stirring device of the static type.
Figure 28:
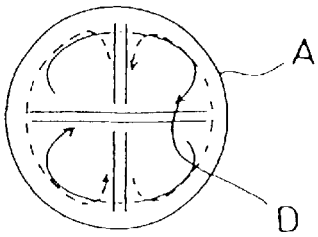
FIG. 28 illustrates the inversion state of fluids at the interface of the right-twisting spiral shaped mixing element B and the left-twisting spiral shaped mixing element C.
Figure 29:
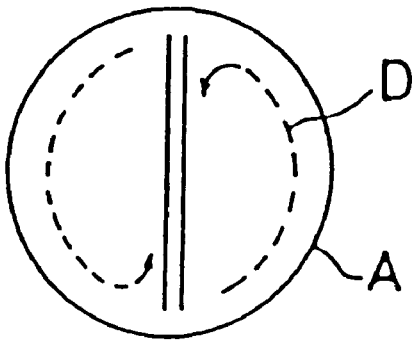
PRIOR ART FIG. 29
FIG. 29 illustrates the flow of fluids along the twisting face of the right-twisting spiral shaped mixing element B.
Figure 30:
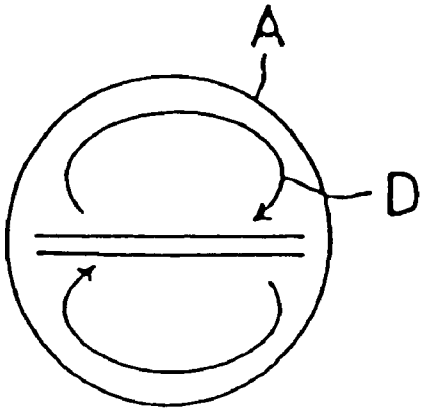
FIG. 30 illustrates the flow of fluids along the twisting face of the left-twisting spiral shaped mixing element C.

FIG. 26 shows a three-dimensionally schematized view of the combined state of the first element 113 and the second element 114 equipped with sandglass-shaped hole parts 117 according the fourth embodiment, and also the flow of fluids 10 passing through the hole parts. Each hole part, whether in the first element or in the second element, includes a first portion (115) and a second portion (116).

In the first element 3 (FIG. 22 and FIG. 23) of the fourth embodiment fluids 10 flowed into the sandglass-shaped hole part 14 from the upper stream side are divided into four at each hole. Assuming that 10 pieces of the first element 3 and 10 pieces of the second element 4 are to be combined, the division number of fluids becomes tremendously huge, because the number of holes is multiplied by the twentieth power of 4. Cavitation of fluids is caused when abrupt enlargement and reduction are repeated over 40 times, and fluids collide violently against the wall face and among fluids themselves, and fluids are subjected to shearing force at the side wall, which causes complex flow accompanied by turbulence (vigorous mixing of fluids 10 at the inlet 15 and outlet 16 of the flow passage), thus enabling fluids to be mixed and dispersed effectively.

As seen in the combination of the first element 3 and the second element 4 in the afore-mentioned first embodiment, fluids 10 are subjected to a considerable amount of shearing force while repeating division, enlargement, and reduction. However, it is designed so that fluids 10 collide against the elements 3·4 at a considerably great angle.

In the fourth embodiment, the elements 3·4 are formed so that the sandglass-shaped hole parts 14 are squarely arranged on the disk body. However, needless to say variations in regards to the elements can be applied. Some modifications include changes in the size of the sandglass-shaped hole part 14, the area ratio of the top and base of the conical frustum, the arrangement of the sandglass-shaped hole parts 14, and the diameter and thickness of the disk of an element, and the like. The way elements themselves are arranged can also be modified. That is, various kinds of modifications are possible besides the combination shown in FIG. 26.

Further, the shape of the hole part 14 need not to be limited to a sandglass shape. So long as the hole part 14 is constricted at one end or halfway (or equipped with a hole part 14 that is provided with a reduced diameter part intermediately), the same effects as those of elements 3·4 according to the fourth embodiment can be expected and employed as a variation of this embodiment.

The first element 3 and the second element 4 shown in the afore-mentioned embodiments can be formed by casting, sintering, or machining. The formation can be performed in any manner. In the embodiments, each element 3·4, employs the method known as the lost wax process to form the static-type mixing and stirring device.

EFFECTS OF THE INVENTION

In the first embodiment of the present invention, there is formed a mixing and stirring device of the static type, comprising a cylindrical case body, and a plural number of disk-shaped elements combined and fitted in alternating sequence into the case body equipped with plural kinds of holes at prescribed intervals, and joint metals removably fitted to the ends of the inlet and outlet of the case body. As a result, unlike the conventional static-type mixing and stirring device, wherein the twisting elements of the extremely complex structure are employed, substantial reduction in the size of the device and the production costs are achieved with the present invention. The same is true of the invention of the second embodiment.

In the third embodiment of the present invention, the mixing and stirring device is integrated with valves, thus allowing the mixing and stirring device of the static type to be installed simply by replacing the valves already in use. As a result, piping space for fixing the static-type mixing and stirring device can be saved. Furthermore, in the present invention, multiple disk-shaped elements, wherein a polygonal pyramid frustum shaped hole part and a hole part equipped with a reduced diameter part are arranged not to be overlapped, are combined and fitted in sequence into a cylindrical case body so as to provide a mixing interface, thus resulting in substantial increase in the number of divisions of fluids and a greater shearing force applied to fluids owing to the velocity changes caused by enlargement and reduction of the passage areas of the hole parts. As a result, the performance of mixing and stirring fluids is tremendously enhanced compared with that of the conventional device.

For the purpose of mixing in accordance with the present invention, tremendous mixing effects are obtained by enlarging the diameter of the hole of the element and arranging the positioning of the hole to reduce friction with the wall face, and making the shape of the hole part moderate though there is seen slightly large pressure loss compared with that of the conventional mixer of the static type (Kenix type). For the purpose of emulsification and dispersion, it also functions suitably.

For the purpose of emulsification and dispersion with the present invention, it is possible that insoluble matters are emulsified and dispersed by reducing the diameter of the hole part of the element, by adjusting the positioning of the upper part and base part of the hole part, and also by shaping the hole part to cause abrupt change. Though pressure loss caused in this case is considerably larger than that of the Kenix type device, the disadvantage can be compensated for by achieving a degree of emulsification and dispersion which cannot be achieved with the Kenix type device.

As described above, the static type mixing and stirring device of the present invention is an economically advantageous device, in which the basic requirements of fluids mixing—that is, the division number of fluids, its shearing force caused by velocity changes, and its directionality—are maximized, while its pressure loss is minimized as much as possible. Various kinds of operations and treatments—from simple mixing to dispersion and emulsification—can be easily achieved simply by changing the number of elements to adjust the mixing process, thus making it highly practical.

Static-type mixing and stirring devices in accordance with the present invention perform more effectively than do conventional mixing devices of the static type, while pressure loss remains nearly the same as with the conventional devices. The compact devices of the present invention can easily replace conventional devices. Furthermore, in some cases, a mixing tank can be left out, forming a tankless system. As explained in detail above, the present invention thus provides an excellent practical and effective contribution.

What is claimed is:

1. A static mixing and stirring device comprising:

a case body having a storage cavity formed within the case body, wherein the case body has an inlet end and an outlet end;

an element layer body disposed in the storage cavity, the element layer body comprising a plurality of disk-shaped first elements and a plurality of a disk-shaped second elements disposed in an alternating and abutting manner, wherein each first element is disposed to fit with and abut against a corresponding adjacent second element, wherein each first element includes a side facing the inlet end, a side facing the outlet end, and a plurality of first hole parts arranged in a periodical and regular square array structure so as not to position any center of any first hole part at a center of the first element, wherein each second element includes a side facing the inlet end, a side facing the outlet end, and a plurality of second hole parts arranged in a periodical and regular square array structure so as to position a center of a central hole part at a center of the second element, wherein the first hole parts and the second hole parts each have a polygonal pyramid frustrum shape or a conical frustrum shape, wherein each frustrum shape has a large opening on the side facing the inlet end and a small opening on the side facing the outlet end of the case body, wherein at least one first element of the plurality of first elements has one first hole part that overlaps four respective second hole parts of a corresponding adjacent second element because the side facing the outlet of the one first element abuts with the side facing the inlet of the corresponding adjacent second element, wherein the small opening of the at least one first hole part of the one first element overlaps the large opening of each of four respective second hole parts of the corresponding adjacent second element thereby providing a mixing interface, wherein a first fluid stream flowing through the one first hole part of the one first element diverges into four first component fluid streams at the mixing interface so that each of the respective four second hole parts of the corresponding adjacent second element receives a different one of the first component fluid streams, and each of the four respective second hole parts of the corresponding second element also receives three other component streams at the mixing interface so that four component fluid streams converge in each of the respective second hole parts to form a second fluid stream flowing through each of the four respective second hole parts of the corresponding second element so that each second fluid stream is formed by the convergence of a respective one of the first four component streams and three other component streams.

* * * * *